United States Patent [19]

Loersch et al.

[11] 4,023,966

[45] May 17, 1977

[54] METHOD OF HOT ISOSTATIC COMPACTION

[75] Inventors: Joseph Frederick Loersch, Bolton; Peter Alan Hurwitz, East Hartford, both of Conn.; Lester Warren Jordan, Cranston, R.I.

[73] Assignee: United Technologies Corporation, Hartford, Conn.

[22] Filed: Nov. 6, 1975

[21] Appl. No.: 629,725

[52] U.S. Cl. ..... 75/226; 75/214; 425/78; 264/56; 264/125

[51] Int. Cl.² ..... B22F 3/00

[58] Field of Search ..... 75/214, 226; 425/78; 264/56, 125

[56] References Cited

UNITED STATES PATENTS

| | | | |
|---|---|---|---|
| 3,450,528 | 6/1969 | Thompson | 75/226 |
| 3,622,313 | 11/1971 | Havel | 75/226 |
| 3,804,575 | 4/1974 | Chandhok | 75/226 |
| 3,841,870 | 10/1954 | Hamjian | 75/214 |

*Primary Examiner*—Brooks H. Hunt

*Attorney, Agent, or Firm*—Edward J. Timmer

[57] ABSTRACT

This invention involves a method for the hot isostatic compaction of particulate material into an article of intricate configuration. It comprises providing a removable pattern in the appropriate precompaction configuration of the article to be produced, coating the pattern with a first layer of conductive material and a second layer of metallic material, the two layers cooperating to provide a self-supporting and gas-impervious shell around the pattern and removing the pattern from the shell to provide a self-supporting and gas-impervious container having an internal configuration corresponding to the precompaction shape of the article to be produced. The container is then filled with particulate material, evacuated and sealed, and isostatically compacted in a pressure vessel at elevated temperature until the particulate material is compacted into a dense article of complex shape. The container is thereafter removed to obtain the compacted article. Dense articles of complex shape, such as gas turbine engine components including blades, discs and the like, are readily produced by the method of the invention.

36 Claims, No Drawings

METHOD OF HOT ISOSTATIC COMPACTION

BACKGROUND OF THE INVENTION

1. Field of Invention

This invention relates to a method of compacting particulate material into dense articles and, more particularly, to a method for the hot isostatic compaction of particulate material into dense articles of intricate configuration.

2. Description of the Prior Art

As is well known, methods of isostatic compaction generally involve placing a mass of particulate material, usually powder, into a container having an internal configuration corresponding to the appropriate precompaction shape of the article to be produced, evacuating and sealing the container and its contents against the atmosphere, placing the container in a pressure vessel wherein isostatic pressure is applied to the container to compact the particulate material into a dense article and thereafter removing the article from the container. Compaction can be conducted at ambient temperatures but generally compaction at elevated temperatures is required to form articles of intricate configuration to high density, especially when the particulate material is a nickel or cobalt-base superalloy powder.

Although the method of isostatic compaction has developed to the degree where articles of high density may be readily obtained, the configuration of such articles has been limited to relatively simple shapes, such as bars, rods or the like, due to the inability of the prior art to devise a suitable container for confining the particles to more complex shapes during compaction. For example, the typical container for compacting powders into articles of simple configuration is one fabricated from metal, such as steel. These so-called metal cans are fabricated to the desired shape by welding sheets or plates of the metal together. However, metal cans of intricate configuration, such as those resembling a gas turbine engine blade, disc and the like, are virtually impossible to construct in this manner. The only practical, existing means by which articles of such configuration can be achieved using metal cans is to subject the compacted article of simple configuration to extensive machining operations. In the case of nickel or cobalt-base superalloys, machining is difficult and time-consuming.

Inherent in the use of metal cans is the further disadvantage that the particulate material may require precompaction to an intermediate density; for example, 70 to 80 percent, prior to final compaction. Precompaction is sometimes necessary because of the inability of the fabricated metal can to shrink to the extent required during compaction of the loose powder (about 50 percent dense) to full density (about 100 percent dense). If the precompaction step is omitted, even an article of simple configuration may exhibit objectionable wrinkles on the surface after compaction.

The inadequacies involved in isostatically compacting with fabricated metal cans resulted in the invention disclosed in U.S. Pat. No. 3,622,313 which issued on Nov. 23, 1971. The method there disclosed comprises sealing a mass of powder in a vitreous container having an internal configuration corresponding to the general shape of the articles to be produced and subjecting the container to hot isostatic compaction. The use of the vitreous container eliminates the need for precompaction of the powder to intermediate density prior to final compaction and enables the production of articles of intricate configuration. However, several disadvantages are associated with the disclosed method. Namely, the vitreous container is fragile and must be handled with care during the operations incident to isostatic compaction. Vacuum integrity of the container is difficult to achieve in thin-walled containers; therefore, thicker walls are necessary and require time-consuming and laborious manufacturing procedures. The surface of the article compacted within the vitreous container is oftentimes rough in nature as a result of the powder sticking to the glass during compaction at high temperatures. Also, the vitreous container tends to sag at elevated temperatures and distortion of the articles being compacted thereby occurs.

Copending U.S. patent application 474,878 now Pat. No. 3,982,934 entitled "Methods Of Powder Metal Formation" filed by Joseph M. Wentzell and assigned to the assignee of the present application discloses a method for isostatically compacting a powdered material, such as superalloy powder, into irregular shapes. Basically, the method comprises forming a thin (2 to 3 mils) electroplated shell in the appropriate precompaction shape of the article to be made, surrounding the shell with a pressure transferring and support media, pressing and sintering the support media, filling the shell with powder to be compacted, placing the filled shell and surrounding support media within a sealable metal can, evacuating and sealing the metal can against the atmosphere, compacting the metal can and powder within a hot pressure vessel wherein isostatic pressure is applied, and removing the metal can, support media and shell from the compacted article. Although the method disclosed is effective in producing compacted articles of intricate and configuration and high density, the steps involved therein are so numerous and time-consuming as to preclude application of the method in the commercial production of complex articles in large quantities. For example, a pressure transmitting and support media, such as iron powder, is required to surround and support the thin (2 to 3 mils) electroplated shell after the casting has been removed therefrom. The support media must be pressed to a density approximately equivalent to that of the powder to be compacted and thereafter sintered. After the electroplated shell is filled with powder, the filled shell and surrounding sintered support media must then be enclosed within a sealable metal can in order that a vacuum can be maintained in and around the powder during compaction at high temperatures. These steps, as well as the numerous others taught in the application, make the disclosed method impractical from a commercial production standpoint.

SUMMARY OF THE INVENTION

It is an object of the present invention to provide a method of hot isostatic compaction which can be used to provide articles of intricate configuration, such as gas turbine engine components including blades, discs and the like, to high densities and to close tolerances, and which overcomes the disadvantage of the prior art methods, as enumerated above.

In its basic concept the present invention involves providing a removable pattern in the appropriate precompaction configuration of the article to be produced; coating the pattern with a first layer of conductive material, the thickness of the layer being sufficient to provide a substantially continuous conductive surface for subsequent coating; coating the first layer with a second layer of metallic material, the thickness of the second layer in combination with the thickness of the first layer being sufficient to provide a self-supporting and gas-impervious shell around the pattern; and removing the pattern from the shell to provide a self-supporting and gas-impervious container having an internal configuration corresponding to the appropriate precompaction shape of the article to be produced. The container is then filled with particulate material, evacuated and sealed against the atmosphere and thereafter isostatically compacted in a pressure vessel at elevated temperature until the particulate material is compacted into a dense article of complex shape. The compacted article is obtained by removing the container therefrom. If desired, a compacted article can be produced which requires very little, if any, machining to achieve the tolerances desired in the final article.

In a preferred embodiment of the invention, the method comprises providing said removable pattern in multiple sections and subjecting each pattern section to the aforementioned steps of the method. After removal of the pattern sections from the shell sections formed therearound, the shell sections are joined together by conventional means to provide a self-supporting and gas-impervious container having an internal configuration corresponding to the appropriate precompaction shape of the article to be produced.

In another embodiment of the invention, the method comprises all of the aforementioned steps of the basic concept and the additional step of treating the pattern prior to coating with the first layer of conductive material to reduce the surface asperity and provide a clean, continuous surface for said coating.

The foregoing and other objects and advantages of the present invention will appear more fully from the following detailed description of the preferred embodiments.

DESCRIPTION OF THE PREFERRED EMBODIMENT

The method of isostatic compaction taught herein can be used to produce dense articles of intricate configuration from many types of particulate material including, but not limited to, metals and their alloys, intermetallic compounds, non-metallic compounds and mixtures thereof. The method is particularly well-suited for the commercial production in large quantities of components usable in or in combination with gas turbine engines such as blades, discs and the like from nickel and cobalt-base superalloy powders.

In the practice of the invention, the pattern of the article to be produced can be provided by conventional and well-known means, such as injection molding, casting into a suitable mold or the like. Injection molding the pattern has been found to be a preferred means for providing large numbers of reproducible patterns of intricate configuration at minimum cost. The pattern is made of a removable material, which may be either nonconductive such as a wax, plastic or the like, or conductive such as a low melting point or dissolvable metal or alloy or the like. Representatives of these categories are standard casting wax sold under the trademark Cerita 921 and manufactured by Argueso Corporation and plastic sold under the trademark Lexan and manufactured by General Electric Company; and zinc, aluminum and lead-tin alloys, respectively. This list is merely representative and is in no way intended to exclude other materials which may be formed into an intricate configuration and which are removable from the shell subsequently formed therearound. Standard casting wax is the preferred pattern material since it is readily molded to complex shapes, low in cost and easily removable from the shell by melting.

It is sometimes desirable and preferred to provide the pattern in multiple sections. For example, for large, cumbersome articles such as large gas turbineengine components, two or more pattern sections, each representing a part of the article to be made, may be provided. These pattern sections are then coated to form self-supporting and gas-impervious shell sections thereon, as described and defined hereinbelow. After the pattern sections are removed from the shell sections, the latter are joined together by conventional means, such as welding or the like to provide a self-supporting and gas-impervious container having an internal configuration corresponding to the appropriate precompaction shape of the article to be produced. This preferred embodiment may be utilized when a pattern of the entire article to be made is not compatible with existing coating or other equipment due to its size or the like.

It is also sometimes desirable and preferred to treat the pattern to reduce the surface asperity and provide a clean, continuous surface for subsequent coating. For example, this treatment is desirable when parting agent from the injection molding operation remains on the surface of the pattern or when the surface of the pattern exhibits objectionable roughness. Conventional treatments such as glass peening, grit blasting, electropolishing or the like are available for this purpose. In treating the pattern to reduce the surface asperity and remove foreign matter, an optimum surface is provided for subsequent coating and, in turn, an optimum surface is provided on the final, compacted article. By such treatments, the character of the surface of the compacted article may be varied.

Coating of the outer surface of the pattern to form a shell having an internal surface of like configuration is accomplished in two stages. The pattern surface is coated with a first layer of conductive material to a sufficient thickness to provide a substantially continuous conductive surface for subsequent coating. The conductive layer may be applied by conventional means such as vacuum deposition, spraying, electroless deposition or the like and may comprise a conductive paint, metallic deposit or the like. Electroless deposition of a metallic deposit produces an optimum conductive layer and is preferred. If contamination of the powder to be compacted is to be avoided, it is desirable that the conductive layer be essentially nonreactive with such powder. For example, in compacting nickel-base superalloy powder, a conductive layer of nickel or iron is preferred. However, under some circumstances, a reactive conductive layer may be desired, if, for example a hardened case is desired on the compacted article.

The first layer of conductive material is thereafter coated with a second layer of metallic material. The thickness of the metallic layer in combination with the thickness of the conductive layer must be sufficient to provide a self-supporting and gas-impervious shell around the pattern. By "self-supporting," we mean that after the pattern has been removed from the shell, the container thus formed or subsequently formed by joining the shell sections together can be handled without special precautions, can be filled with and will confine the particulate material in the desired configuration throughout the elevated temperature isostatic compaction process without exterior support and without sagging and, in addition, possesses sufficient plasticity at the compaction temperature to effectively transmit the applied pressure to the particulate material contained therein. Thus, there is no distortion of the article being compacted and no need to surround the container with a pressure transmitting and support media.

By "gas-impervious," we mean that said container can be evacuated to reduced internal pressure and sealed and that the container can maintain this condition throughout the isostatic compaction process. Thus, there is no need to enclose the container in a metal can or the like to maintain an atmosphere of reduced pressure in and around the particulate material to be compacted. It must be emphasized that it is the thickness of the metallic layer in combination with the thickness of the conductive layer that provides the heretofore unavailable combination of desirable properties exhibited by the shell, and subsequently formed container. The cooperation between the two juxtaposed layers is essential to the present invention.

The metallic layer can be applied by conventional means such as dipping, vacuum deposition, spraying, electroplating or the like. Since electroplating provides a uniform, nonporous metallic layer, it is the preferred method for applying the coating. The metallic layer must be compatible with the layer of conductive material; i.e. the juxtaposed layers must exhibit bonding of some type to form a unitary shell. Due to the rapid diffusion of the coating constituents at elevated temperatures, the metallic layer should be essentially nonreactive with the powder to be compacted if contamination thereof is to be avoided during hot isostatic compaction. For example, in compacting nickel-base superalloy powder, a metallic layer of nickel or iron is preferred.

Although not necessary to the method of the invention, additional gas-impervious layers may be applied over the metallic layer. These layers may be metallic or non-metallic; for example, metals or alloys, ceramics or the like and can be used to repair a shell which has been punctured or damaged.

After the pattern has been coated with the layer of conductive material and layer of metallic material to form a self-supporting and gas-impervious shell therearound, the pattern is removed to provide a container which has an internal configuration corresponding to the appropriate precompaction shape of the article to be produced. The container is self-supporting and gas-impervious, as defined above. If the pattern has been provided in multiple sections, the pattern sections are removed from the self-supporting and gas-impervious shell sections therearound and the shell sections are then joined by conventional means to form said self-supporting and gas-impervious container. Removal of the pattern from the shell can be accomplished by conventional means, such as by melting, dissolving, leaching or burning the pattern.

Particulate material, for example, nickel or cobalt-base superalloy powder, is then introduced in the prescribed amount into the container through a suitably disposed opening, attached hollow stem or the like. During filling, it is desirable to vibrate the container to assure a uniform dispersion of powder throughout. Means for introducing the particulate material into the container and for vibrating the container are well known in the prior art.

The interior of the container must be evacuated to a reduced pressure, such as $4 \times 10^{-5}$ mm of mercury, to preclude reaction of the particulate material with gases and to minimize void formation during hot isostatic compaction. Evacuation may be conducted simultaneously with the introduction of the powder; for example, by filling the container in a vacuum chamber, or may be conducted after the container has received the prescribed amount of particulate material; for example, after filling in air, a vacuum pump can be suitably connected to the container and the interior brought to reduced pressure. In either case, the container is sealed against the atmosphere after filling. If a hollow stem has been attached to the container to facilitate filling, the container may be sealed by crimping the stem onto itself and welding the crimped area closed. Other well known sealing techniques may also be used, however.

It should be emphasized that in the method of the invention, precompaction of the particulate material to intermediate density prior to final isostatic compaction is not required to prevent the occurrence of wrinkles on the surface of the compacted article. In addition, there is no need to support the container by surrounding it with a support media or to enclose the container within a sealable metal can to maintain a vacuum therein, since the container itself is self-supporting and gas-impervious throughout the isostatic compaction process.

The filled and sealed container is placed in a pressure vessel and a gas, such as argon, helium or the like, is introduced into the vessel until the proper compaction pressure, such as 10,000 to 25,000 psi, is attained. Heating to the desired compacting temperature, for example, 2000° F to 2500° F, may be done before, during or after gas introduction. The combination of applied isostatic pressure and temperature compacts the container and particulate material therein to the desired high density article of intricate configuration. During compaction in accordance with the method of the invention, the container maintains the desired internal configuration and does not sag so as to distort the shape of the article being produced. However, the container is sufficiently plastic at the elevated temperatures of compaction to effectively transmit the applied pressure to the particulate material contained therein.

After compaction, the container is removed from the pressure vessel and then from the compacted article. Removal of the container from the article can be effected by machining, dissolution (pickling) or any conventional means. A dense article of desired intricate configuration and close tolerances is thereby provided. The degree of density obtainable by the present invention varies with the type of particulate material being compacted, some materials being more readily compacted than others. Consequently, as used herein, a dense article is one having a density of at least 70 percent of the theoretical density of the particulate material involved.

Having thus described our invention, the following example of the formation of a gas turbine engine blade from a nickel-base superalloy powder is offered to illustrate it in more detail.

EXAMPLE

A removable pattern having the appropriate precompaction configuration of a turbine blade was provided by injection molding a standard casting wax into a suitable die. The pattern was then very lightly peened with fine, powdered glass at 15 to 20 psi to effect removal of the parting agent from the injection molding operation and to reduce any surface asperity present. To form the shell, the treated pattern was immersed in an electroless nickel depositing solution sold under the trademark Cuposit PM980 and manufactured by Shipley Company, Inc. of Newton, Massachusetts. After 10 minutes, the treated pattern was removed from the solution and exhibited a deposit of nickel from 0.010 to 0.015 mils in thickness. The treated and coated pattern was thereafter immersed in a nickel sulfamate electroplating solution comprising 10 to 12 ounces of nickel metal per gallon of solution. An electroplated layer of nickel was deposited to a thickness of between 40 to 60 mils by application of a current of 30 to 40 amperes per square foot for 50 hours. The pattern with the self-supporting and gas-impervious shell therearound was then heated to 200° F, thereby causing the wax to melt and be removed from the shell. To assure essentially complete removal of the wax, the shell interior was further cleaned with trichlorethylene solvent and thereafter burned at 1750° F. A hollow stainless steel stem was then attached to the container by welding. Nickel-base superalloy powder generally known as IN-100 having a nominal composition of 9.5% Cr, 15% Co, 4.8% Ti, 5.5% Al, 3.0% Mo, .17% C, remainder Ni and of 325 or smaller mesh was then introduced into the container by placing a funnel on the stem and pouring the powder therein. During filling, the container was vibrated vigorously. When the desired amount of powder was added, the stem of the container was attached to a vacuum pump and the pressure reduced to about $4 \times 10^{-5}$ mm of mercury inside the container. Just prior to sealing the container, a final vigorous vibration was applied. The container was sealed by heating the stem locally and mechanically crimping the stem on itself. The crimped area was then welded to assure vacuum sealing. The filled and sealed container was then placed in a pressure vessel. Argon gas was admitted to the vessel until a pressure of 15,000 psi was reached. Simultaneously, the vessel was heated to 2250° F. The container remained at temperature and pressure for 180 minutes. After compaction, the container was removed from the vessel and chemically dissolved from around the compacted turbine blade. The blade thus exposed exhibited good surface finish and the desired intricate configuration. Density of the blade was determined to be near 100 percent.

The above example is merely illustrative and it is obvious that changes may be made without departing from the scope and spirit of the invention.

Having thus described typical embodiments of our invention, that which we claim as new and desire to secure by Letters Patent of the United States is:

1. A method for hot isostatic compaction of particulate material into an article of intricate configuration comprising the steps of:

a. providing a removable pattern in the appropriate precompaction configuration of the article to be made;

b. coating the pattern with a first layer of conductive material, the thickness of said layer being sufficient to provide a substantially continuous conductive surface;

c. electroplating over the first layer with a second layer of metallic material, the thickness of said second layer in combination with the thickness of said first layer being sufficient to provide a self-supporting and gas-impervious shell around the pattern;

d. removing the pattern from the shell, thereby providing a self-supporting and gas-impervious container for receiving and confining the particulate material in the appropriate precompaction configuration of the article to be made;

e. filling the container with particulate material, including the step of establishing a vacuum therein;

f. sealing the container against the atmosphere;

g. compacting the container and particulate material at elevated temperature by isostatic pressure so that a dense article of desired configuration is formed from the particulate material; and h. removing the container from the compacted article.

2. The method of claim 1 wherein the removable pattern is treated to reduce the surface asperity and provide a clean, continuous surface prior to coating with said first layer of conductive material.

3. The method of claim 1 wherein the pattern is a nonconductive material.

4. The method of claim 3 wherein the pattern is casting wax.

5. The method of claim 1 wherein the pattern is formed in a mold cavity.

6. The method of claim 5 wherein the pattern is injection molded.

7. The method of claim 1 wherein the first layer of conductive material is applied by electroless-deposition.

8. The method of claim 1 wherein the first layer of conductive material is a metallic deposit.

9. The method of claim 1 wherein the second layer of metallic material is coated with at least one gas-impervious layer.

10. The method of claim 1 wherein the pattern is provided in the shape of a gas turbine engine component.

11. The method of claim 1 wherein the particulate material is a superalloy powder.

12. A method for hot isostatic compaction of particulate material into an article of intricate configuration comprising the steps of:

a. providing a removable pattern in multiple sections in the appropriate precompaction configuration of the article to be made;

b. coating the pattern sections with a first layer of conductive material, the thickness of said layer being sufficient to provide a substantially continuous conductive surface;

c. electroplating over the first layer with a second layer of metallic material, the thickness of said second layer in combination with the thickness of said first layer being sufficient to provide self-supporting and gas-impervious shell sections around the pattern sections;

d. removing the pattern sections from the shell sections;

e. joining the shell sections together, thereby providing a self-supporting and gas-impervious container for receiving and confining the particulate material in the appropriate precompaction configuration of the article to be made;

f. filling the container with particulate material, including the step of establishing a vacuum therein;

g. sealing the container against the atmosphere;

h. compacting the container and particulate material at elevated temperature by isostatic pressure so that a dense article of desired configuration is formed from the particulate material; and i. removing the container from the compacted article.

13. The method of claim 12 wherein each pattern section is treated to reduce the surface asperity and provide a clean, continuous surface prior to coating with said first layer of conductive material.

14. The method of claim 12 wherein the pattern is a nonconductive material.

15. The method of claim 14 wherein the pattern is casting wax.

16. The method of claim 12 wherein each pattern section is formed in a mold cavity.

17. The method of claim 12 wherein the first layer of conductive material is applied by electroless-deposition.

18. The method of claim 12 wherein the first layer of conductive material is a metallic deposit.

19. The method of claim 12 wherein the second layer of metallic material is coated with at least one gas-impervious layer.

20. The method of claim 12 wherein the shell sections are joined together by welding.

21. The method of claim 12 wherein the pattern of multiple sections is provided in the shape of a gas turbine engine component.

22. The method of claim 12 wherein the particulate material is a superalloy powder.

23. A method for hot isostatic compaction of nickel-base superalloy particulate material into a gas turbine engine component comprising the steps of:

a. providing a removable, nonconductive pattern in the appropriate precompaction configuration of the component to be made;

b. electroless-depositing on the pattern a first layer of conductive material, the thickness of said layer being sufficient to provide a substantially continuous conductive surface for subsequent coating;

c. electroplating the first layer with a second layer of metallic material, the thickness of said second layer in combination with the thickness of said first layer being sufficient to provide a self-supporting and gas-impervious shell around the pattern;

d. removing the pattern from the shell, thereby providing a self-supporting and gas-impervious container for receiving and confining the powder in the appropriate precompaction configuration of the component;

e. filling the container with particulate material, including the step of establishing a vacuum therein;

f. sealing the container against the atmosphere;

g. compacting the container and particulate material at elevated temperature by isostatic pressure so that a near 100 percent dense component is formed from the particulate material; and h. removing the container from the compacted component.

24. The method of claim 23 wherein the pattern is injection molded.

25. The method of claim 23 wherein the pattern is casting wax.

26. The method of claim 23 wherein the pattern is glass peened to reduce the surface asperity and provide a clean, continuous surface prior to coating with the first layer of conductive material.

27. The method of claim 23 wherein the first layer of conductive material is a metallic deposit.

28. The method of claim 27 wherein the metallic deposit is nickel.

29. The method of claim 27 wherein the metallic deposit is iron.

30. The method of claim 23 wherein the second layer of metallic material is nickel.

31. The method of claim 23 wherein the second layer of metallic material is iron.

32. The method of claim 23 wherein the component is a disc.

33. The method of claim 23 wherein the thickness of the layer of conductive material is at least 0.010 mils.

34. The method of claim 23 wherein the thickness of the second layer in combination with the thickness of the first layer is at least 40 mils.

35. A method for forming a self-supporting and gas-impervious container for use in the hot isostatic compaction of particulate material into an article of intricate configuration comprising the steps of:

a. providing a removable pattern in the appropriate precompaction configuration of the article to be made;

b. coating the pattern with a first layer of conductive material, the thickness of said layer being sufficient to provide a substantially continuous conductive surface;

c. electroplating over the first layer with a second layer of metallic material, the thickness of said second layer in combination with the thickness of said first layer being sufficient to provide a self-supporting and gas-impervious shell around the pattern; and d. removing the pattern from the shell.

36. A method for forming a self-supporting and gas-impervious container for use in the hot isostatic compaction of particulate material into an article of intricate configuration comprising the steps of:

a. providing a removable pattern in multiple sections in the appropriate precompaction configuration of the article to be made;

b. coating the pattern sections with a first layer of conductive material, the thickness of said layer being sufficient to provide a substantially continuous conductive surface;

c. electroplating over the first layer with a second layer of metallic material, the thickness of said second layer in combination with the thickness of said first layer being sufficient to provide self-supporting and gas-impervious shell sections around the pattern sections;

d. removing the pattern sections from the shell sections; and e. joining the shell sections together.

* * * * *